US005350732A

United States Patent [19]

Kosydar et al.

[11] Patent Number: 5,350,732

[45] Date of Patent: Sep. 27, 1994

[54] SUBBING LAYER FOR DYE-DONOR ELEMENT USED IN THERMAL DYE TRANSFER

[75] Inventors: Karen M. Kosydar, Penfield; Stephen M. Neumann, Rochester; Robert G. Spahn, Webster; Edward P. Otocka, Pittsford, all of N.Y.

[73] Assignee: Eastman Kodak Company, Rochester, N.Y.

[21] Appl. No.: 198,022

[22] Filed: Feb. 17, 1994

[51] Int. Cl.[5] ..... B41M 5/035; B41M 5/38

[52] U.S. Cl. ..... 503/227; 428/195; 428/209; 428/480; 428/702; 428/704; 428/913; 428/914

[58] Field of Search ..... 8/471; 428/195, 209, 428/480, 689, 702, 704, 913, 914; 503/227

[56] References Cited

U.S. PATENT DOCUMENTS 4,737,486 4/1988 Henzel ..... 503/227

*Primary Examiner*—B. Hamilton Hess

*Attorney, Agent, or Firm*—Harold E. Cole

[57] ABSTRACT

A dye-donor element for thermal dye transfer comprising a support having on one side thereof, in order, a subbing layer and a dye layer, and wherein the subbing layer comprises a vacuum-deposited metal oxide, and wherein either a) an infrared-absorbing material is contained in the dye layer or a layer associated therewith, or b) the other side of the support has a slipping layer thereon.

18 Claims, No Drawings

SUBBING LAYER FOR DYE-DONOR ELEMENT USED IN THERMAL DYE TRANSFER

This invention relates to dye donor elements used in thermal dye transfer, and more particularly to the use of a certain subbing layer for the dye layer.

In recent years, thermal transfer systems have been developed to obtain prints from images which have been generated electronically in digital form, such as from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

U.S. Pat. No. 4,737,486 discloses the use of a titanium alkoxide as a subbing layer between a support and a dye layer. While this material is a good subbing layer for adhesion, problems have arisen with hydrolytic instability, and the layer is difficult to coat in a reproducible manner. For example, a coating solution of this material can pick up water from the atmosphere which would then render it ineffective. Further, this material has to be coated from organic solvents which have many environmental concerns. This makes the manufacturing process costly from a waste standpoint and environmentally undesirable because of the necessary disposal of large quantities of organic solvent. In addition, when the material is successfully coated, some of the organic solvents are also vented to the atmosphere which is undesirable. Further, while this material acts as a fairly good barrier layer to dye migration, further improvements are desirable.

It is an object of this invention to provide a subbing layer for a dye layer which has good adhesion. It is another object of this invention to provide a subbing layer for a dye layer which has good hydrolytic stability. It is yet another object of this invention to provide a subbing layer, the manufacture of which does not require organic solvents, thus avoiding environmental problems. It is still another object of the invention to provide a subbing layer which has good barrier layer properties to unwanted dye migration.

These and other objects are achieved in accordance with this invention which relates to a dye-donor element for thermal dye transfer comprising a support having on one side thereof, in order, a subbing layer and a dye layer, and wherein the subbing layer comprises a vacuum-deposited metal oxide, and wherein either a) an infrared-absorbing material is contained in the dye layer or a layer associated therewith, or b) the other side of the support has a slipping layer thereon.

Metal oxides which can be used in the invention include, for example, aluminum oxide, silicon oxide, titanium oxides, etc. Vacuum-deposited aluminum oxide layers on a polyester film (12 μthick) are available commercially from CAMVAC LTD as Camclear XL ®. Camclear O ® and Camclear M ®. Vacuum-desposited silicon oxide layers on a 6 μm poly(ethylene terephthalate) support are also available commercially from several suppliers such as Courtaulds Performance Films. In addition, titanium oxides, silicon oxide, and aluminum oxide can be vacuum-deposited on 6 μm poly(ethylene terephthalate) by electron beam gun evaporations at an appropriate level of oxygen background gas in a vacuum web coater.

The subbing layer of the invention may be present in any concentration which is effective for the intended purpose. In general, good results have been attained using a laydown of from about 0.05 $g/m^2$ to about 0.5 $g/m^2$.

Any image dye can be used in the dye-donor employed in the invention provided it is transferable to the dye-receiving layer by the action of the thermal print head or laser. Especially good results have been obtained with sublimable dyes such as anthraquinone dyes, e.g., Sumikaron Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumikaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumiacryl Blue 6G ® (product of Sumitomo Chemical Co., Ltd.), and Aizen Malachite Green ® (product of Hodogaya Chemical Co., Ltd.);

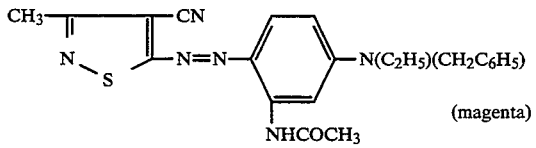

(magenta)

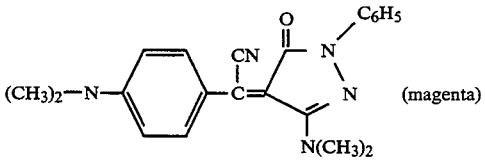

(magenta)

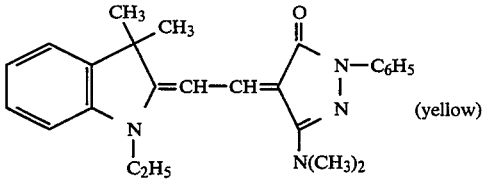

(yellow)

-continued

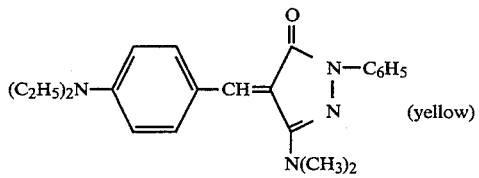

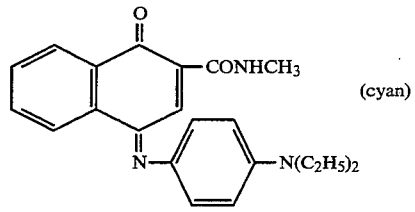

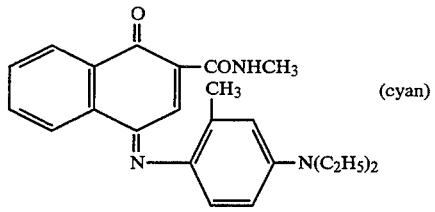

any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 5 g/m$^2$ and are preferably hydrophobic.

Any material can be used as the support for the dye-donor element of the invention provided it is dimensionally stable and can withstand the heat of the laser or thermal head. Such materials include polyesters such as poly(ethylene terephthalate); poly(ethylene naphthalate); polyamides; polycarbonates; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 μm and may also be coated with a subbing layer, if desired, such as those materials described in U.S. Pat. Nos. 4,695,288 or 4,737,486.

For embodiments of the invention where a thermal printing head is employed to transfer dye from the dye-donor element, the reverse side of the dye-donor element is coated with a slipping layer to prevent the printing head from sticking to the dye-donor element. Such a slipping layer would comprise either a solid or liquid lubricating material or mixtures thereof, with or without a polymeric binder or a surface-active agent. Preferred lubricating materials include oils or semicrystalline organic solids that melt below 100° C. such as poly(vinyl stearate), beeswax, microcrystalline wax, perfluorinated alkyl ester polyethers, polycaprolactone, silicone oils, Poly(tetrafluoroethylene), carbowaxes, poly(ethylene glycols), or any of those materials disclosed in U.S. Pat. Nos. 4,717,711; 4,717,712; 4,737,485; and 4,738,950, and EP 285,425, page 3, lines 25–35. Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40 weight %, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, an ivory paper, a condenser paper or a synthetic paper such as DuPont Tyvek®. Pigmented supports such as white polyester (transparent polyester with white pigment incorporated therein) may also be used. The dye-receiving element may also comprise a solid, injection-molded material such as a polycarbonate, if desired.

The dye image-receiving layer may comprise, for example, a polycarbonate, a polyurethane, a polyester, poly(vinyl chloride), poly(styrene-co-acrylonitrile), polycaprolactone, a poly(vinyl acetal) such as poly(vinyl alcohol-co-butyral), poly(vinyl alcohol-co-benzal), poly(vinyl alcohol-co-acetal) or copolymers or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only the dye thereon as described above or may have alternating areas of other different dyes, such as sublimable cyan and/or magenta and/or yellow and/or black or other dyes. Such dyes are disclosed in U.S. Pat. Nos. 4,541,830, 4,541,830, 4,698,651, 4,695,287; 4,701,439, 4,757,046, 4,743,582, 4,769,360 and 4,753,922, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of cyan, yellow and a dye as described above which is of magenta hue, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCS001), a TDK Thermal Head F415 HH7-1089 or a Rohm Thermal Head KE 2008-F3.

A laser may also be used to transfer dye from the dye-donor elements of the invention. When a laser is used, it is preferred to use a diode laser since it offers substantial advantages in terms of its small size, low cost, stability, reliability, ruggedness, and ease of modulation. In practice, before any laser can be used to heat a dye-donor element, the element must contain an infrared-absorbing material, such as carbon black or cyanine infrared-absorbing dyes as described in U.S. Pat. No. 4,973,572, or other materials as described in the following U.S. Pat. Nos.: 4,948,777, 4,950,640, 4,950,639, 4,948,776, 4,948,778, 4,942,141, 4,952,552, 5,036,040, and 4,912,083, the disclosures of which are hereby incorporated by reference. The infrared-absorbing material may be incorporated in the dye layer itself or a layer associated therewith. The laser radiation is absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat.

Lasers which can be used to transfer dye from dye-donors employed in the invention are available commercially. There can be employed, for example, Laser Model SDL-2420-H2 from Spectra Diode Labs, or Laser Model SLD 304 V/W from Sony Corp.

A thermal printer using a laser as described above to form an image on a thermal print medium is described in U.S. Pat. No. 5,168,288, the disclosure of which is hereby incorporated by reference.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed three times using different dye-donor elements. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

Adhesion Test

Individual dye-donor elements were prepared by coating the dye layers identified below onto the vacuum-deposited metal oxide support as specified in Table 1.

Dye Layer D-1

A magenta dye layer consisting of 0.15 g/m$^2$ of the second magenta dye illustrated above; 0.14 g/m$^2$ of the first magenta dye illustrated above; 0.08 g/m$^2$ cellulose acetate propionate (2.5% acetyl, 45% propionyl) 0.5 sec viscosity; 0.24 g/m$^2$ cellulose acetate propionate (2.5% acetyl, 45% propionyl) 20 sec viscosity; 0.01 g/m$^2$ S-363N1 beads (a micronized blend of polyethylene, polypropylene, and oxidized polyethylene particles available from Shamrock Technologies, Inc.); and 0.002 g/m$^2$ Fluorad FC-430® surfactant available from 3M Corp., coated from a toluene, methanol, and cyclopentanone solvent mixture.

Dye Layer D-2

A cyan dye layer consisting of 0.39 g/m$^2$ of the first cyan dye illustrated above; 0.11 g/m$^2$ of the second cyan dye illustrated above; 0.28 g/m$^2$ cellulose acetate propionate (2.5% acetyl, 45% propionyl) 20 sec viscosity; 0.06 g/m$^2$ of the glass illustrated below; 0.02 g/m$^2$ S-363N1 beads; and 0.002 g/m$^2$ Fluorad FC-430® coated from a toluene, methanol, and cyclopentanone solvent mixture.

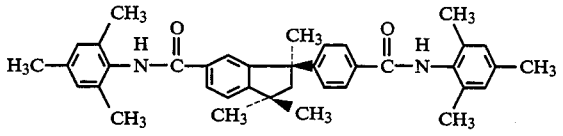

Glass

Dye Layer D-3

A magenta dye layer consisting of a 0.15 g/m$^2$ of the first magenta dye illustrated above; 0.39 g/m$^2$ cellulose acetate propionate (2.5% acetyl, 45% propionyl) 0.5 sec viscosity; and 0.004 g/m$^2$ Fluorad FC-431® coated from 2-butanone.

Control dye-donor elements were prepared by coating the dye layers described above onto 6 μm thick poly(ethylene terephthalate) which had been previously coated with 0.13 g/m$^2$ Tyzor TBT® (a titanium tetra-n-butoxide available from DuPont).

In addition, some dye-donor elements were prepared by coating the dye layers described above directly onto bare poly(ethylene terephthalate).

The backside of the dye-donor elements containing Dye Layer D-1 was coated with a slipping layer consisting of 0.011 g/m$^2$ PS-513 (an aminopropyl dimethyl-terminated polymethylsiloxane available from Petrarch Systems, Inc.); 0.0003 g/m$^2$ p-toluenesulfonic acid; 0,032 g/m$^2$ Montan wax; 0.45 g/m$^2$ cellulose acetate propionate (2.5% acetyl, 45% propionyl) 0.5 sec viscosity; and 0.08 g/m$^2$ cellulose acetate propionate (2.5% acetyl, 45% propionyl) 20 sec viscosity coated from a toluene, methanol, and cyclopentanone solvent mixture.

Dye-donor elements containing Dye Layer D-2 were not coated with a slipping layer on the backside. To facilitate slipping, neat PS-513 was applied to the printer head prior to printing.

The backside of the dye-donor elements containing Dye Layer D-3 was coated with a slipping layer consisting of Emralon 329® (a dry film lubricant of poly(-tetrafluoroethylene) particles available from Acheson Colloids Co.) (0.54 g/m$^2$), coated from a n-propyl acetate, toluene, isopropyl alcohol and n-butyl alcohol solvent mixture.

Adhesion of the dye layer to the metal oxide subbing layer was determined by its resistance to removal by 3M Scotch Magic Tape #810®. The tape was applied to the dye layer and then quickly removed. The amount of dye layer removed by the tape was estimated (as a percent of the layer) visually as follows:

TABLE 1

| DYE LAYER ON ELEMENT | METAL OXIDE SUBBING LAYER | THICKNESS OF METAL OXIDE LAYER (nm) | AMOUNT OF DYE LAYER REMOVED (%) |
|---|---|---|---|
| D-2 | $Al_2O_3$ CAMCLEAR L ® | 20 | 0 |
| D-2 | $Al_2O_3$ CAMCLEAR O ® | 25 | 0 |
| D-2 | $Al_2O_3$ CAMCLEAR M ® | 20 | 0 |
| D-1 | SiO | 80 | 0 |
| D-1 | SiO | 40 | 0 |
| D-3 | TiO | 100 | 5 |
| D-3 | $TiO/TiO_2$ | 50 | 10 |
| D-1 | Control* | NA | 0 |
| D-2 | Control* | NA | 10 |
| D-3 | Control* | NA | 10 |
| D-1 | None (Control) | NA | >99 |
| D-3 | None (Control) | NA | >90 |

*Tyzor TBT ®

The above results show that the subbing layers of the invention have adhesion as good as the Tyzor TBT ® control, but without the disadvantages of this material as discussed above.

EXAMPLE 2

Dye Barrier Test

Dye-receiver elements used in this example were prepared as follows:

Receiver 1

The following layers were coated in order onto a microvoided polypropylene layer laminated to paper support as described in U.S. Pat. No. 5,244,861 with a poly(vinyl alcohol)/poly(ethylene oxide) antistatic backing layer:

1) a subbing layer of Z-6020 (Dow-Corning Corp.) (0.11 g/m$^2$)from 99% ethanol/1% water solvent mixture;
2) a receiving layer of KL3-1013 (polyether-modified bisphenol A polycarbonate, Bayer AG) (1.78 g/m$^2$), Lexan 141 ® (bisphenol A polycarbonate, General Electric Co.) (1.45 g/m$^2$), diphenyl phthalate (0.32 g/m$^2$), dibutyl phthalate (0.32 g/m$^2$), and Fluorad FC-431 ® (a perfluorosurfactant, 3M Corp.) (0.01 g/m$^2$)from methylene chloride solvent; and
3) an overcoat layer of a bisphenol A polycarbonate containing 49 mol % diethylene glycol and 1 mol % polydimethylsiloxane (0.22 g/m$^2$), DC-510 Silicone Fluid (Dow-Corning Corp., 0.008 g/m$^2$), and Fluorad FC-431 ® (0.016 g/m$^2$)coated from methylene chloride solvent.

Receiver 2

The following layers were coated in order on a white-reflective support of titanium dioxide pigmented polyethylene overcoated paper stock:

1) subbing layer of poly(acrylonitrile-co-vinylidene chloride-co-acrylic acid) (14:79:7 wt. ratio) (0.08 g/m$^2$)coated from butanone; 2) dye-receiving layer of diphenyl phthalate (0.32 g/m$^2$), di-n-butyl phthalate (0.32 g/m$^2$), and Fluorad FC-431 ® (a perfluorosurfactant, 3M Corp.) (0.01 g/m$^2$), in a mixture of Makrolon 5700 ® (a bisphenol-A-polycarbonate, Bayer AG) (1.6 g/m$^2$)and a linear condensation polymer derived from carbonic acid, bisphenol-A, and diethylene glycol (bisphenol: glycol mole ratio 50:50, molecular weight approx. 200,000) (1.6 g/m$^2$) coated from dichloromethane; and
3) overcoat layer of the bisphenol-A-glycol polycarbonate listed above (0.22 g/m$^2$) containing Fluorad FC-431 ® (0.01 g/m$^2$), DC-510 Silicone Fluid (Dow-Corning Corp.) (0.016 g/m$^2$) coated from dichloromethane.

On the reverse side of each dye-receiving element a backing layer was coated as described in Example 1 of U.S. Pat. No. 5,096,875.

Note that Receiver 1 was used with dye-donor elements containing Dye Layers D-1 and D-2 and Receiver 2 was used with a dye-donor element containing Dye Layer D-3.

Printing—For Dye-Donor Elements Containing Dye Layer D-2

The dye side of the dye-donor element, approximately 10 cm×15 cm in area, was placed in contact with the polymeric receiving layer side of the dye-receiver element of the same area. The assemblage was fastened to the top of a motor-driven, 60 mm diameter, rubber roller and a TDK Thermal Head, model L-231, thermostatted at 25° C. was pressed with a force of 36 Newtons against the dye-donor element side of the assemblage pushing it against the rubber roller. This print head has 512 independently addressable heaters, with a resolution of 5.4 dots/mm and an active printing width of 95 mm.

The image electronics were activated and the assemblage was drawn between the printing head and the roller at 6.9 mm/sec. Coincidentally, the resistive elements in the thermal print head were pulsed for 29 μsec/pulse at 128 μsec intervals during the 33 msec/dot printing time. A stepped density image was generated by incrementally increasing the number of pulses/dot from 0 to 255. The voltage supplied was 24.5 Volts resulting in an instantaneous peak power of approximately 1.4 Watts/dot and the maximum total energy required to print a maximum reflection density >2.0 was 10.5 mjoules/dot.

Printing—For Dye-Donor Elements Containing Dye Layer D-1

Same as above except that the mechanism was operated at a maximum of 20.7 volts to achieve comparable density.

Printing—For Dye-Donor Elements Containing Dye Layer D-3

The resistive elements in the thermal print head were pulsed on for 128 msec every 130 msec. Since the duty cycle for each pulse is 98.5%, this approximates pulse width modulation. Printing maximum density requires 154 pulses "on" time per printed line of 19.7 msec for 33.8 msec allotted print time or 58.2% duty cycle. The voltage supplied was 14 volts resulting in an instantaneous peak power of approximately 0.38 watts/dot and the maximum total energy required to print a maximum density of 2.3 was 7.6 mjoules/dot.

Ability of the subbing layers to function as barriers was assessed by measuring (using densitometry with Status A filters) the residual dye transported into the support during printing of a maximum density area.

This was done by removing the dye donor layer after printing using an acetone wash and inspecting the support itself. The change in density is defined as the support density (in the appropriate color) remaining after printing minus the support density remaining in an unprinted sample. The data obtained are shown in Table 2 as follows:

TABLE 2

| DYE TRANSFER TO THE SUPPORT | | | |
|---|---|---|---|
| DYE LAYER ON ELEMENT | METAL OXIDE SUBBING LAYER | THICKNESS OF METAL OXIDE LAYER (nm) | DELTA DENSITY IN SUPPORT |
| D-2 | $Al_2O_3$ CAMCLEAR L ® | 20 | 0 |
| D-2 | $Al_2O_3$ CAMCLEAR O ® | 25 | 0 |
| D-2 | $Al_2O_3$ CAMCLEAR M ® | 20 | 0 |
| D-1 | SiO | 80 | 0 |
| D-1 | SiO | 40 | 0 |
| D-3 | TiO | 100 | 0 |
| D-3 | $TiO/TiO_2$ | 50 | 0 |
| D-1 | * | | 0.05 |
| D-2 | * | | 0.14 |
| D-3 | * | | 0.10 |

*Tyzor TBT ®

The above data show that elements with the vacuum-deposited metal oxide subbing layers have less dye in the support and thus function as better barrier layers than the control titanium tetra-n-butoxide subbing layer.

The invention has been described in detail with particular reference to preferred embodiments thereof, but it will be understood that variations and modifications can be effected within the spirit and scope of the invention.

What is claimed is:

1. A dye-donor element for thermal dye transfer comprising a support having on one side thereof, in order, a subbing layer and a dye layer, and wherein said subbing layer comprises a vacuum-deposited metal oxide, and wherein either a) an infrared-absorbing material is contained in said dye layer or a layer associated therewith, or b) the other side of the support has a slipping layer thereon.

2. The element of claim 1 wherein said metal oxide is an aluminum oxide, a silicon oxide or a titanium oxide.

3. The element of claim 1 wherein said metal oxide is an aluminum oxide.

4. The element of claim 1 wherein said metal oxide is a silicon oxide.

5. The element of claim 1 wherein said metal oxide is a titanium oxide.

6. The element of claim 1 wherein said support is poly(ethylene terephthalate).

7. A process of forming a dye transfer image comprising:

(a) imagewise-heating a dye-donor element comprising a support having on one side thereof, in order, a subbing layer and a dye layer, and (b) transferring a dye image to a dye-receiving element to form said dye transfer image, wherein said subbing layer comprises a vacuum-deposited metal oxide, and wherein either a) an infrared-absorbing material is contained in said dye layer or a layer associated therewith, or b) the other side of the support has a slipping layer thereon.

8. The process of claim 7 wherein said metal oxide is an aluminum oxide, a silicon oxide or a titanium oxide.

9. The process of claim 7 wherein said metal oxide is an aluminum oxide.

10. The process of claim 7 wherein said metal oxide is a silicon oxide.

11. The process of claim 7 wherein said metal oxide is a titanium oxide.

12. The process of claim 7 wherein said support is poly(ethylene terephthalate).

13. A thermal dye transfer assemblage comprising (a) a dye-donor element comprising a support having on one side thereof, in order, a subbing layer and a dye layer, and (b) a dye-receiving element comprising a support having thereon a dye image-receiving layer, said dye-receiving element being in a superposed relationship with said dye-donor element so that said dye layer is in contact with said dye image-receiving layer, wherein said subbing layer comprises a vacuum-deposited metal oxide, and wherein either a) an infrared-absorbing material is contained in said dye layer or a layer associated therewith, or b) the other side of the dye-donor support has a slipping layer thereon.

14. The assemblage of claim 13 wherein said metal oxide is an aluminum oxide, a silicon oxide or a titanium oxide.

15. The assemblage of claim 13 wherein said metal oxide is an aluminum oxide.

16. The assemblage of claim 13 wherein said metal oxide is a silicon oxide.

17. The assemblage of claim 13 wherein said metal oxide is a titanium oxide.

18. The assemblage of claim 13 wherein said dye-donor support is poly(ethylene terephthalate).

* * * * *